United States Patent [19]

Coppin

[11] Patent Number: 4,690,635

[45] Date of Patent: Sep. 1, 1987

[54] HIGH TEMPERATURE BURNER ASSEMBLY

[75] Inventor: William Coppin, Muncie, Ind.

[73] Assignee: Maxon Corporation, Muncie, Ind.

[21] Appl. No.: 887,441

[22] Filed: Jul. 21, 1986

[51] Int. Cl.[4] ..... F23C 7/00

[52] U.S. Cl. ..... 431/187; 431/353

[58] Field of Search ..... 431/187, 188, 353; 239/424.5

[56] References Cited

U.S. PATENT DOCUMENTS

| | | | |
|---|---|---|---|
| 2,458,543 | 1/1949 | Urquhart | 431/188 |
| 3,676,048 | 7/1972 | Sellors et al. | 431/187 |
| 3,809,525 | 5/1974 | Wang et al. | 431/353 |
| 4,181,491 | 1/1980 | Hovis | 431/188 |

*Primary Examiner*—Carroll B. Dority, Jr.

[57] ABSTRACT

The high-temperature burner assembly of the present invention includes an oxygen containing nozzle body which has a gas conduit insert disposed therein. The gas conduit insert includes a gas conduit insert tip which has a substantially flat exterior tip face with a frusto-conical shaped prominence disposed thereon and protruding from the tip face. The gas conduit insert tip includes a centrally disposed gas channel terminating at the proximal end of the frusto-conical shaped prominence to form a knife edge to provide reduced available surface for accumulation of carbon and for briefly delaying the combustion. An oxygen expelling orifice is concentrically disposed about the frusto-conical shaped prominence for directing oxygen therefrom to mix with the gaseous fuel for combustion within a refractory burner block.

11 Claims, 5 Drawing Figures

HIGH TEMPERATURE BURNER ASSEMBLY

BACKGROUND OF THE INVENTION

The present invention is directed to burners in general and more specifically to a high-temperature burner assembly.

Prior art burner assemblies include those which are disclosed and claimed in U.S. Pat. No. 2,368,370. Such prior art burner assemblies have been beneficial for a number of different uses, including the heat treating of metals, and over a wide range of temperatures up to approximately 1750° F. Moreover, such furnaces have included features such as a sufficient turndown range to render such furnace available for multiple uses.

In recent years, and especially in particularized applications such as the glass-making art, it has been necessary to provide a furnace having the capacity to produce temperatures of up to 5000° F., but to do so without severely diminishing burner life, further to do so without the undue complication of providing for water cooling mechanisms. Moreover, to provide such temperatures, and to do so without the formation of any substantial amount of carbon build-up on the burner mechanism, has likewise been necessary, as carbon build-up would contaminate the glass or other sensitive material being heat processed.

In view of the above deficiencies and difficulties with the prior art, it is an object of the present invention to provide an improved high-temperature burner assembly which will materially diminish such prior art difficulties, and which will do so by providing structure which will function to delay flame combustion for a few micro-seconds in order to move the flame away from the burner surface, and thus to increase the useful working life of the burner, and reduce any contamination therefrom.

It has also been an object of the improved high-temperature burner assembly of the present invention to provide a unique gas orifice shape which provides no substantially available surface on which carbon may accumulate during the burning thereof.

It has been a yet further object of the improved high-temperature burner assembly of the present invention to provide a gas orifice structure which will produce temperatures in excess of up to 5000° F., but which will permit the surrounding portions of the structure to remain at substantially lower temperatures, thereby to lengthen the burner life substantially.

These and other objects of the present invention will become apparent to those of ordinary skill in the art upon review of the following summary of the invention, brief description of the drawing, detailed description of preferred embodiments, the appended claims, and the accompanying drawing.

SUMMARY OF THE INVENTION

The high temperature burner assembly of the present invention includes a nozzle body for containing and conducting oxygen therein, and a concentrically disposed gas conduit insert disposed within the nozzle body. The gas nozzle insert includes a means for directing a gaseous fuel through the nozzle body to expel the gaseous fuel from the conduit and to mix with the oxygen for burning in a sustainable flame. The flame burns within a refractory burner block of dimensions and shape for substantially containing the flame within.

The gas conduit insert tip includes a tip face which is substantially flat on the exterior surface thereof, and includes, in preferred embodiments, a substantially frusto-conical shaped prominence disposed on and protruding from the exterior surface of the tip face. The gas conduit insert tip includes a central gas channel centrally disposed therethrough and terminating at the proximal end of the frusto-conical shaped prominence to form substantially a knife edge rim thereon. The knife edge shape of the rim of such frusto-conical prominence serves to delay combustion and to provide no substantially available surface for the accumulation of carbon build-up thereon.

An oxygen expelling orifice means is also provided as an opening concentrically disposed about the base of the frusto-conical shaped prominence for directing oxygen therefrom to mix with the gaseous fuel directed from the proximal end of the central gas channel of the frusto-conical prominence for combustion substantially within the refractory burner block.

A number of advantages of the present invention include the ability to burn at substantially higher temperatures than those of the prior art, to do so with a considerable reduction in contamination previously caused by carbon build-up, and further to do so with considerably extended burner life. Other advantages of the present invention will become apparent to those of ordinary skill in the art.

BRIEF DESCRIPTION OF THE DRAWING

Preferred embodiments of the improved high-temperature burner assembly of the present invention are depicted in the following figures, and in which.

DETAILED DESCRIPTION OF PREFERRED EMBODIMENTS

Figure 1:
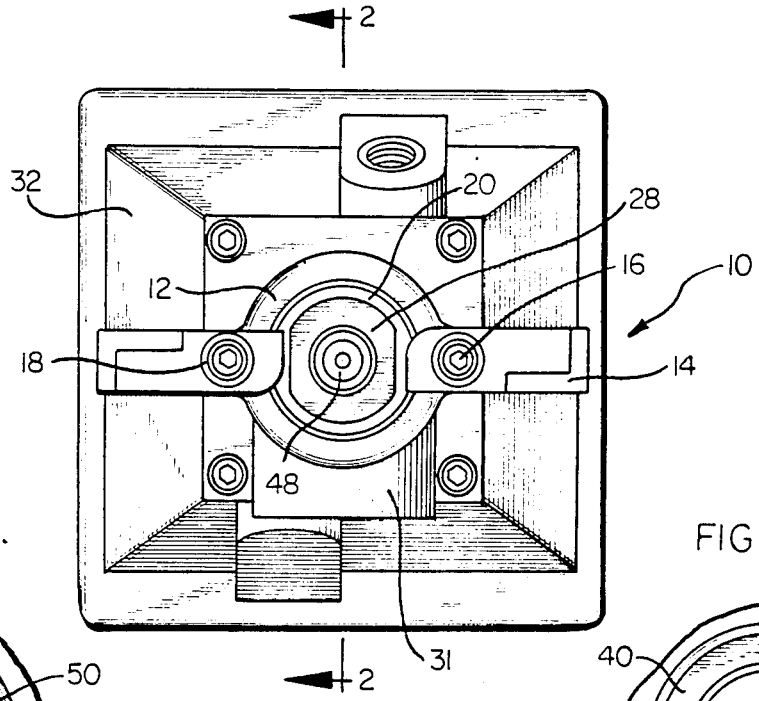
FIG. 1 is a rearview of the improved high-temperature burner of the present assembly showing the nozzle body for containing oxygen, and into which is disposed a gas conduit insert held by means of an insert lock.

The high-temperature burner assembly of the present invention includes a nozzle body for containing oxygen therein and for conveying oxygen therethrough. A gas conduit is disposed within the nozzle body and has means thereon for directing a gaseous fuel therethrough to be expelled from the conduit and to mix with the oxygen for burning in a sustainable flame.

The nozzle body and gas conduit contained therein are suitable for use in association with a refractory burner block for substantially containing the flame.

The improved high-temperature burner assembly of the present invention further includes a gas conduit tip connected to the gas conduit and includes a substantially flat exterior tip face. The exterior tip face has a substantially frusto-conical shaped prominence disposed thereon and protruding from the tip face.

The gas conduit tip also includes a central gas channel centrally disposed therethrough and terminating at the proximal end of the frusto-conical shaped prominence to form substantially knife edge shaped rim thereon. The knife edge shaped rim structure functions to delay combustion for a few micro-seconds, and to provide no substantial available surface for the accumulation of carbon thereon. The opening of central gas channel is preferably disposed in a plane spaced at a selected distance away from the plane of tip face.

Oxygen expelling orifice means open concentrically about the base of frusto-conical shaped prominence for directing oxygen outwardly therefrom to mix with the gaseous fuel for combustion.

In one preferred embodiment of the high-temperature burner assembly of the present invention, the oxygen expelling orifice means comprises a plurality of oxygen holes having diameters substantially smaller than that of central gas channel. In such preferred embodiments, oxygen holes are disposed in a circular array, which array is substantially concentric with the central gas channel. Such oxygen holes may open onto the tip face, or in alternative preferred embodiments may and the base of the frusto-conical shaped prominence.

In other preferred enbodiments, the oxygen expelling orifice means may comprise an annular shaped orifice contained in the tip face, and disposed substantially concentrically with respect to the central gas channel.

Yet further preferred embodiments of the high-temperature assembly of the present invention may utilize an oxygen expelling orifice means which comprises both a plurality of oxygen holes disposed in a circular array and an annular shaped orifice. In such embodiments, both of the plurality of oxygen holes and the annular shaped orifice are disposed substantially concentrically with the central gas channel. In such preferred embodiments the annular shaped orifice is preferably disposed concentrically within the circular array of oxygen holes.

In preferred embodiments of the high-temperature burner assembly of the present invention, the refractory block has a central opening therein which substantially conforms to the shape of the flame created by the burner. In such embodiments, the combustion of the gaseous fuel is substantially contained within the refractory burner block.

Figure 2:
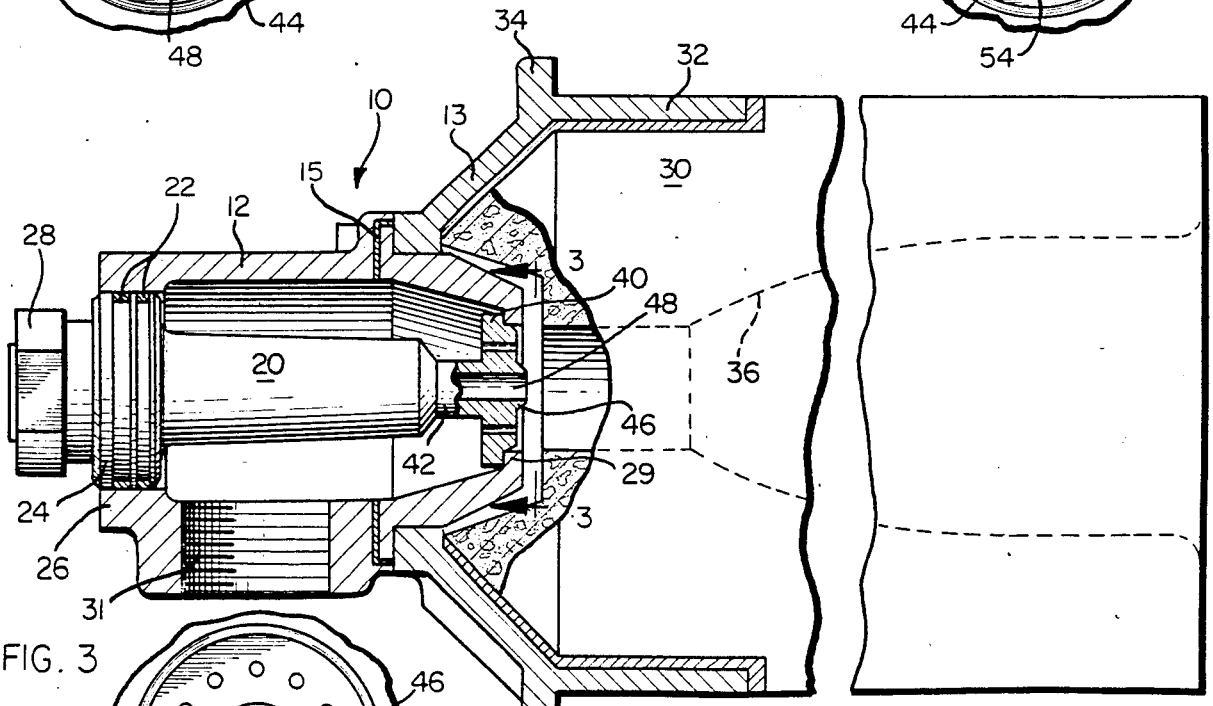
FIG. 2 is a cross-sectional view of the embodiment of the improved high-temperature burner assembly of FIG. 1 taken along lines 2—2 thereof, and further showing the gas conduit insert tip including a substantially flat exterior tip face with a substantially frusto-conical shaped prominence disposed and protruding from the tip face thereof, and further showing a centrally disposed central gas channel terminating at the proximal end of the frusto-conical shaped prominence to form substantial a knife edge rim thereon, with oxygen expelling orifice means disposed about the central gas channel, and to form a flame which is substantially confined within the refractory burner block, and with the burner block being held by means of a block mounting frame.

Referring now to the drawing, and to FIGS. 1 and 2 thereof in particular, the high-temperature burner assembly of the present invention generally 10 includes a nozzle body 12 for containing oxygen therein which may be secured by an insert lock 14 and by suitable attachment means including bolts 16 and washers 18.

A gas conduit 20 is disposed within nozzle body 12 and has means thereon for directing a gaseous fuel therethrough to be expelled from gas conduit 20 and to mix with the oxygen for burning in a sustainable flame. Gas conduit 20 may preferably have one or more O-ring seals 22 disposed at the rear portion 24 thereof for effectuating a seal with rear lip portion 26 of nozzle body 12, and further includes a gas connector 28 disposed and extending rearwardly therefrom. Such nozzle body 12 and gas conduit 20 are substantially sealed at the proximal portion 29 thereof by suitable pressure fit engagement techniques known to those of ordinary skill in the art. Such nozzle body 12 further includes an oxygen inlet 31 which may be disposed downwardly as shown in FIGS. 1 and 2, but such direction may be varied in other embodiments. Nozzle body 12 joins with preferably separate retainer 13 formed of an alloy material sufficient to withstand the increased heat formed by the flame. Such retainer 13 is preferably sealingly engaged with nozzle body 12 by gasket 15.

The nozzle body 12 and gas conduit 20 contained therein are suitable for use in association with a refractory burner block 30 and are secured to nozzle body 12 by means of block support holder 32 which may include block support holder brackets 34 perpherally disposed thereon. Such refractory burner block 30 includes a central bore 36 of a size and shape selected for substantially containing the flame.

Figure 4:
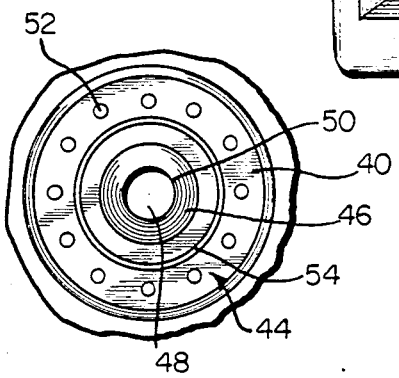
FIG. 4 is an enlarged front view of a further alternative embodiment showing both a plurality of oxygen holes disposed in a circular array and an angular shaped orifice, both of which are disposed substantially concentrically with respect to the central gas channel.
Figure 5:
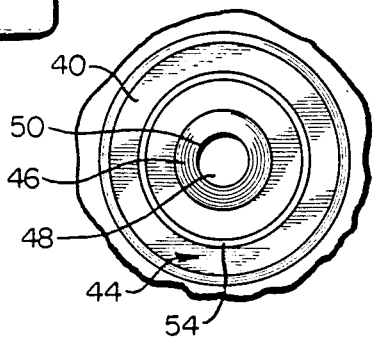
FIG. 5 is a depiction of an alternative embodiment showing an angular shaped orifice contained in the tip face and disposed substantially concentrically with respect to the central gas channel.
Figure 3:
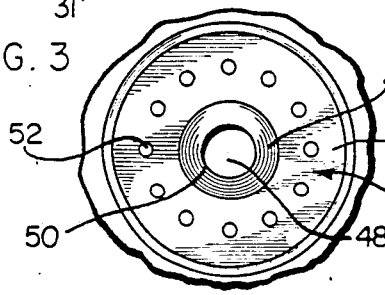
FIG. 3 is an enlarged front view taken along lines 3—3 of FIG. 2 and showing a plurality of oxygen holes concentrically disposed about the base of the frusto-conical shaped prominence for directing oxygen outwardly therefrom to mix with the gaseous fuel existing from the central gas channel for flame formation in the plane above the surface of the page.

As shown particularly in FIGS. 3–5, the improved high-temperature burner assembly 10 of the present invention further includes a gas conduit tip 40 connected to gas conduit 20 by gas conduit channel 42 and includes a substantially flat exterior tip face surface 44. Exterior tip face 44 has a substantially frusto-conical shaped prominence 46 disposed thereon and protruding from tip face 44.

Gas conduit tip 40 also includes a central gas channel 48 centrally disposed therethrough and terminating at the proximal end of frusto-conical shaped prominence 46 to form substantially a knife edge shaped rim 50 thereon. Such knife edge shaped rim 50 structure functions to delay combustion for a few micro-seconds, and to provide no substantial available surface for the accumulation of carbon thereon. The opening of central gas channel 48 is preferably disposed in a plane spaced at a selected distance away from the plane of tip face 44.

Referring again now in particular to FIGS. 3–5, in various embodiments different oxygen expelling orifice means open concentrically about the base of frusto-conical shaped prominence 46 for directing oxygen outwardly therefrom to mix with the gaseous fuel for combustion into central bore 36 of refractory burner block 30.

In the embodiment of the high-temperature burner assembly 10 of the present invention shown in FIG. 3, the oxygen expelling orifice means comprises a plurality of oxygen holes 52 having diameters substantially smaller than that of central gas channel 48. In such preferred embodiment, oxygen holes 52 are disposed in a circular array, which array is substantially concentric with central gas channel 48. Such oxygen holes 52 may open onto top face 44, or in alternative preferred embodiments may open at the junction of tip face 44 and the base of the frusto-conical shaped prominence 46.

In the embodiment of the high-temperature assembly 10 of the present invention as shown in FIG. 4, the oxygen expelling orifice means comprises both a plurality of oxygen holes 52 disposed in a circular array and an annular shaped orifice 54. In such embodiments, both of the plurality of oxygen holes 52 and the annular shaped orifice 54 are disposed substantially concentrically with respect to central gas channel 48. In such preferred embodiments, annular shaped orifice 54 is preferably disposed concentrically within the circular array of oxygen holes 52.

In the preferred embodiment of FIG. 5, the oxygen expelling orifice means comprises solely the annular shaped orifice 54 contained in tip face 44, and disposed substantially concentrically with respect to central gas channel 48, which functions in the manner described, supra.

In the above description, specific details of an embodiment of the invention has been provided for a thorough understanding of the invention concepts. It will be understood by those skilled in the art that many of these details may be varied without departing from the spirit and scope of the invention.

What is claimed is:

1. In a high temperature burner assembly having a nozzle body for containing and conveying oxygen, a gas conduit disposed within the nozzle body and having means for directing a gaseous fuel therethrough to be expelled from the conduit and to mix with the oxygen for burning in a sustainable flame, and for use in association with a refractory burner block for substantially containing such flame, the improvement comprising:

a gas conduit tip connected to the gas conduit and including a substantially flat exteriorly disposed tip face, said tip face having a substantially frusto-conical shaped prominence disposed on and protruding from said tip face;

said gas conduit tip having a central gas channel centrally disposed therethrough and terminating at the proximal end of said frusto-conical shaped prominence to form substantially a knife edge shaped rim for briefly delaying combustion and to provide no substantial available surface for carbon accumulation thereon; and primary oxygen expelling orifice means opening concentrically about the base of said frusto-conical shaped prominence for directing oxygen outwardly therefrom to mix with the gaseous fuel for initial combustion.

2. The improvement of claim 1 wherein said oxygen expelling orifice means comprises a plurality of oxygen holes each having a diameter substantially smaller than that of said central gas channel.

3. The improvement of claim 2 wherein said oxygen holes are disposed in a circular array which array is substantially concentric with said central gas channel.

4. The improvement of claim 1 wherein said oxygen holes open onto said tip face.

5. The improvement of claim 1 wherein said oxygen holes open at the junction of said tip face and said base of said frusto-conical shaped prominence.

6. The improvement of claim 1 wherein said oxygen expelling orifice means comprises an annularshaped orifice contained in said tip face and disposed substantially concentrically with respect to said central gas channel.

7. The improvement of claim 1 wherein said oxygen expelling orifice means comprises both a plurality of oxygen holes disposed in a circular array and an annular-shaped orifice, both of which are disposed substantially concentrically with said central gas channel.

8. The improvement of claim 7 wherein said annular-shaped orifice is disposed concentrically within the circular array of said oxygen holes.

9. The improvement of claim 1 wherein said refractory block has a central opening therein which substantially conforms to the shape of the flame created by said burner.

10. The improvement of claim 1 wherein such combustion is substantially within the refractory burner block.

11. The improvement of claim 1 wherein the opening of said central gas channel is disposed in a plane spaced at a selected distance away from the plane of said tip face.

* * * * *